US009752338B2

(12) United States Patent
Strayer, Jr. et al.

(10) Patent No.: US 9,752,338 B2
(45) Date of Patent: Sep. 5, 2017

(54) VERTICAL SUPPORT APPARATUS FOR A TELESCOPING SEATING SYSTEM

(71) Applicants: Richard D. Strayer, Jr., Pittsburgh, PA (US); Ronald D. Strayer, Latrobe, PA (US)

(72) Inventors: Richard D. Strayer, Jr., Pittsburgh, PA (US); Ronald D. Strayer, Latrobe, PA (US)

( * ) Notice: Subject to any disclaimer, the term of this patent is extended or adjusted under 35 U.S.C. 154(b) by 27 days.

(21) Appl. No.: 14/818,763

(22) Filed: Aug. 5, 2015

(65) Prior Publication Data

US 2016/0040444 A1 Feb. 11, 2016

Related U.S. Application Data

(60) Provisional application No. 62/035,454, filed on Aug. 10, 2014.

(51) Int. Cl.
*E04H 3/12* (2006.01)
*G05G 5/04* (2006.01)

(52) U.S. Cl.
CPC ..... *E04H 3/123* (2013.01); *G05G 5/04* (2013.01)

(58) Field of Classification Search
CPC ..... E04H 3/123
USPC ..... 52/8, 9, 10
See application file for complete search history.

(56) References Cited

U.S. PATENT DOCUMENTS 2,183,056 A 12/1939 Albach et al.
3,088,176 A 5/1963 Delf et al.
3,222,827 A 12/1965 Smith
3,279,131 A 10/1966 Curra, Jr.
3,335,533 A 8/1967 Bahr
3,389,511 A 6/1968 Drehobl
3,400,502 A 9/1968 Scaggs et al.
3,478,473 A 11/1969 Hoven
3,608,251 A 9/1971 Scaggs
4,045,921 A 9/1977 Molloy
RE29,635 E 5/1978 McClelland et al.
4,155,202 A 5/1979 Hartman
4,467,569 A 8/1984 Blanchard et al.
4,557,080 A 12/1985 Walworth et al.
4,565,036 A * 1/1986 Lyman, Jr. ..... E04H 3/123 297/DIG. 2
5,069,007 A 12/1991 Paddock
5,369,918 A 12/1994 Beu
5,784,835 A 7/1998 McArthur, Jr.
(Continued)

*Primary Examiner* — Charles A Fox
*Assistant Examiner* — James Buckle, Jr.
(74) *Attorney, Agent, or Firm* — The Webb Law Firm

(57) ABSTRACT

A telescoping seating system comprising a plurality of seating levels arranged in a vertically stacked orientation, the plurality of seating levels comprising a bottom seating level and at least one upper seating level. The at least one upper seating level further comprises a support structure having at least one nose beam configured to support a seating portion, and at least one vertical support element provided on a surface of the at least one nose beam, wherein the at least one vertical support element is sized and positioned so as to minimize substantially direct contact with the seating portion of an adjacent seating level during opening and closing of the telescoping seating system, and to provide vertical support between adjacent seating levels in an event of vertical loading on the seating levels when the telescoping seating system is in the closed position.

15 Claims, 7 Drawing Sheets

(56) References Cited

U.S. PATENT DOCUMENTS

| | | | | |
|---|---|---|---|---|
| 5,819,475 | A | 10/1998 | Momose | |
| 5,822,929 | A | 10/1998 | Guiles et al. | |
| 5,921,031 | A * | 7/1999 | Williams | E04H 3/123 160/333 |
| 6,041,554 | A * | 3/2000 | McArthur, Jr. | E04H 3/123 52/183 |
| 6,199,324 | B1 * | 3/2001 | Guiles | E04H 3/123 52/8 |
| 6,212,828 | B1 | 4/2001 | McArthur, Jr. | |
| 6,324,790 | B1 | 12/2001 | Victor et al. | |
| 6,354,041 | B1 | 3/2002 | Guiles et al. | |
| 6,539,672 | B1 | 4/2003 | Frost | |
| 6,598,351 | B2 * | 7/2003 | Hallberg | E04H 3/123 52/6 |
| 6,852,382 | B2 * | 2/2005 | Monson | F16F 1/3732 248/562 |
| 6,854,216 | B2 | 2/2005 | Ahrens et al. | |
| 7,617,635 | B2 | 11/2009 | Jacobs et al. | |
| 8,296,999 | B2 * | 10/2012 | Uhl | E04H 3/126 52/66 |
| 8,407,943 | B2 | 4/2013 | Sudkamp et al. | |
| 8,438,786 | B2 | 5/2013 | Jacobs et al. | |
| 9,021,746 | B1 * | 5/2015 | Uhl | E04H 3/126 52/8 |
| 2008/0190038 | A1 * | 8/2008 | Jacobs | A47C 1/126 52/9 |
| 2011/0099915 | A1 * | 5/2011 | Sudkamp | B66F 7/0658 52/9 |
| 2012/0144758 | A1 | 6/2012 | Koch et al. | |
| 2013/0055647 | A1 | 3/2013 | Favell | |

* cited by examiner

VERTICAL SUPPORT APPARATUS FOR A TELESCOPING SEATING SYSTEM

CROSS REFERENCE TO RELATED APPLICATIONS

This application claims benefit under 35 U.S.C. §119(e) of U.S. Provisional Application No. 62/035,454, filed Aug. 10, 2014, the contents of which are incorporated herein in their entirety.

BACKGROUND OF THE INVENTION

Field of the Invention

The present invention generally relates to telescoping seating systems. More particularly, the present invention relates to a vertical support element, or plurality of vertical support elements, configured to provide vertical structural support to a telescoping seating system when the seating system is in a closed position.

Description of Related Art

Telescoping seating systems, such as bleachers, are commonly used in gymnasiums and other areas where high-volume seating is desired. Stacked, telescoping bleacher levels of varying number may be used, depending on the size of the area and the amount of seating desired. Each bleacher level has both a seat portion and a foot support portion. In an "open" configuration, the bleacher levels are pulled away from an anchor point, such as a wall, in a step-wise fashion, such that the lowest, first level is pulled furthest from the anchor point, the second level is pulled second furthest from the anchor point, and so forth. In a "closed" configuration, on the other hand, the bleacher levels are pushed back into a stacked position, wherein the faces of the seating portions of each bleacher level are substantially vertically flush with one another. This configuration enables the bleachers to be stored when not in use, allowing the area normally housing the plurality of open bleacher levels to be available for other uses.

Referring to FIG. 1, an example of a telescoping seating system 100 according to the prior art is shown. Seating system 100 is shown in a closed position, wherein a plurality of stacked bleacher levels 108, 110, 112, 114, 116, 118, 120 extend from a wall 102 along a floor 104. In this closed configuration, each bleacher level 108, 110, 112, 114, 116, 118 is retracted to be substantially flush with the corresponding levels. As is well known in the art, when bleacher levels 108, 110, 112, 114, 116, 118 are in an open configuration, the levels extend from wall 102 in a step-wise fashion to provide a plurality of accessible seating levels. A wheeled track system 106 enables the plurality of bleacher levels 108, 110, 112, 114, 116, 118 to open in this step-wise fashion along floor 104. Upper-most bleacher levels 118 and 120 in FIG. 1 do not extend or retract with the other bleacher levels, as they are fixed to wall 102 and/or a stationary vertical support post 136.

Each bleacher level 108, 110, 112, 114, 116, 118, has a rear riser beam 121, one or more perpendicular brace beams 122 extending from the rear riser beam, a nose beam 128 attached to brace beams 122 and running parallel to riser beams 121, a foot platform 124, a seat bracket 130 attached to nose beam 128, a horizontal seat portion 132 attached to seat bracket 130, and a vertical seat portion 134 attached to seat bracket 130. While not entirely shown in FIG. 1, each bleacher level 108, 110, 112, 114, 116, 118 also has two or more vertical support posts 126. Riser beams 121 are attached to vertical support posts 126, and when in an open configuration, vertical support posts 126 for each bleacher level 108, 110, 112, 114, 116 also provide vertical support for the bleacher level immediately above.

As FIG. 1 shows, lower-most bleacher level 108 is provided constant vertical support at or near nose beam 128 via a front vertical support beam 138, with wheeled track system 106 attached, regardless of whether the system 100 is in an open or closed configuration. Conversely, however, bleacher levels 110, 112, 114, 116, 118 are provided no vertical support at or near nose beam 128 when in the closed configuration illustrated in FIG. 1. As such, each bleacher level 110, 112, 114, 116, 118 is cantilevered from its respective connection of riser beams 121 to vertical support posts 126, potentially causing bleacher levels 110, 112, 114, 116, 118 to sag. This sagging may be caused simply by long-term gravity stress, but is often exacerbated by individuals climbing up/on the bleacher levels while they are in the closed position. Over time, such vertical stress and sagging may cause vertical support posts 126, brace beams 122, and/or riser beams 121 to bend, which may allow the front of one or more bleacher levels to interfere with adjacent levels, thereby causing difficulty with opening and closing the system. This difficulty may include an upper level dragging on a lower level, uneven opening/closing of levels, or partial opening/closing of levels. If the levels do not open in a straight, even line bottom-to-top, it may cause torque on vertical support posts 126 and the overall connecting structure. If not repaired, this torque misaligns vertical support posts 126 and the connecting structure increasingly over time.

Remedies for this sagging bleacher level issue include repairs to straighten vertical deck support posts, fabrication of custom support brackets at the rear riser beams, and/or complete replacement of bent vertical support posts. While such repairs mitigate the need for replacement of the entire telescoping seating system, the issue of sagging bleacher levels and need for costly and time-consuming repairs will likely reoccur without some form of vertical support for the front of each bleacher level. As such, several proposed solutions have been developed to provide this vertical support. One such solution has support wheels mounted on extensions from the bottom surface of a level/platform, such that the wheels travel along the foot platform below during opening and closing operations. However, this solution requires spaces or gaps in the seating portion of the lower level to enable the wheels to pass through the seating portion as the bleacher system is rolled into a stacked position.

Another solution is to have wheels mounted to the bottom of each bleacher level that travel along a customized support beam, wherein the support beam is mounted on each lower bleacher level between the rear riser beam and the seating portion. This customized support beam is at a height equal to the lower seating portion height, such that as the bleacher system approaches a stacked/stored position, the wheels travel off of the support beam and onto the lower seating portion to create a vertical support between bleacher levels down to the floor. One disadvantage of this solution is that the custom support beams can only be placed at the ends of each bleacher level, as they represent a tripping hazard if placed elsewhere along the width of the bleacher level. Having only one or two vertical supports on the ends of the bleacher level may not provide the necessary vertical support to prevent sagging.

Another proposed solution eliminates the custom support beam and instead relies only on wheels mounted to the bottom of each bleacher level, wherein the wheels intersect with the top of the seat portion below as the bleacher system approaches the stacked/closed position. However, this solution is not effective if the levels are at all bent or sagging, as the wheels will not roll smoothly onto the seating portions, causing seat and/or structural damage if the bleachers are unable to open and close according to their designed sequence. Additionally, these wheel-based support systems require expensive modifications to existing bleacher systems, and are in general permanently installed and not customizable.

Accordingly, there is a need for a front vertical support apparatus between adjacent bleacher levels that is low cost, may be retrofitted into existing systems, and requires little to no maintenance or monitoring after installation.

SUMMARY OF THE INVENTION

Generally, provided is a vertical support apparatus for a telescoping seating system. Preferably, provided are solid multi-sided vertical support elements configured to provide vertical support to adjacent seating levels of a telescoping seating system in the closed position in the event of vertical loading or the effects of gravity over a period of time.

According to one preferred and non-limiting aspect, provided is a telescoping seating system configurable between open and closed positions, the system comprising: a plurality of seating levels arranged in a vertically stacked orientation, the plurality of seating levels comprising a bottom seating level adjacent a floor and at least one upper seating level above the bottom seating level. The at least one upper seating level further comprises: a seating portion, a foot platform, a support structure for supporting the seating portion and the foot platform, wherein the support structure comprises at least one nose beam configured to support at least the seating portion, and at least one vertical support element provided on a surface of the at least one nose beam, wherein the at least one vertical support element is sized and positioned so as to minimize substantially direct contact with the seating portion of an adjacent seating level during opening and closing of the telescoping seating system, and to provide vertical support between adjacent seating levels in an event of vertical loading on one or more of the seating levels when the telescoping seating system is in the closed position.

In another preferred and non-limiting aspect, provided is a telescoping seating system configurable between open and closed positions, the system comprising: a plurality of seating levels arranged in a vertically stacked orientation, the plurality of seating levels comprising a bottom seating level adjacent a floor and at least one upper seating level above the bottom seating level. The at least one upper seating level further comprises: a seating portion, a foot platform, a support structure for supporting the seating portion and the foot platform, and at least one vertical support element provided on an underside surface of a portion of the support structure, wherein the at least one vertical support element is a solid multi-sided element sized to fit within a gap between the underside surface of the portion of the support structure and the seating portion of an adjacent seating level positioned below.

In another preferred and non-limiting aspect, provided is a vertical support element for use in a telescoping seating system, the vertical support element comprising: a solid multi-sided element having at least a first surface and a second surface opposite the first surface, wherein the second surface has at least one chamfered edge, one or more attachment hardware recesses formed through the solid multi-sided element between the first surface and the second surface for attaching the solid multi-sided element to an underside surface of a first seating level forming part of the telescoping seating system, and wherein the height of the solid multi-sided element between the first surface and the second surface is determined based on a distance between the underside surface of the first seating level and a seating portion of a second seating level positioned below the first seating level.

These and other features and characteristics of the present invention, as well as the methods of operation and functions of the related elements of structures and the combination of parts and economies of manufacture, will become more apparent upon consideration of the following description and appended claims with reference to the accompanying drawings, all of which form a part of the specification, wherein like reference numerals designate corresponding parts in various figures. It is to be expressly understood, however, that the drawings are for the purpose of illustration and description only and are not intended as a definition of the limits of the invention. As used in the specification and claims, the singular form of "a," "an," and "the" include plural referents unless the context clearly dictates otherwise.

DESCRIPTION OF THE INVENTION

Figure 1:
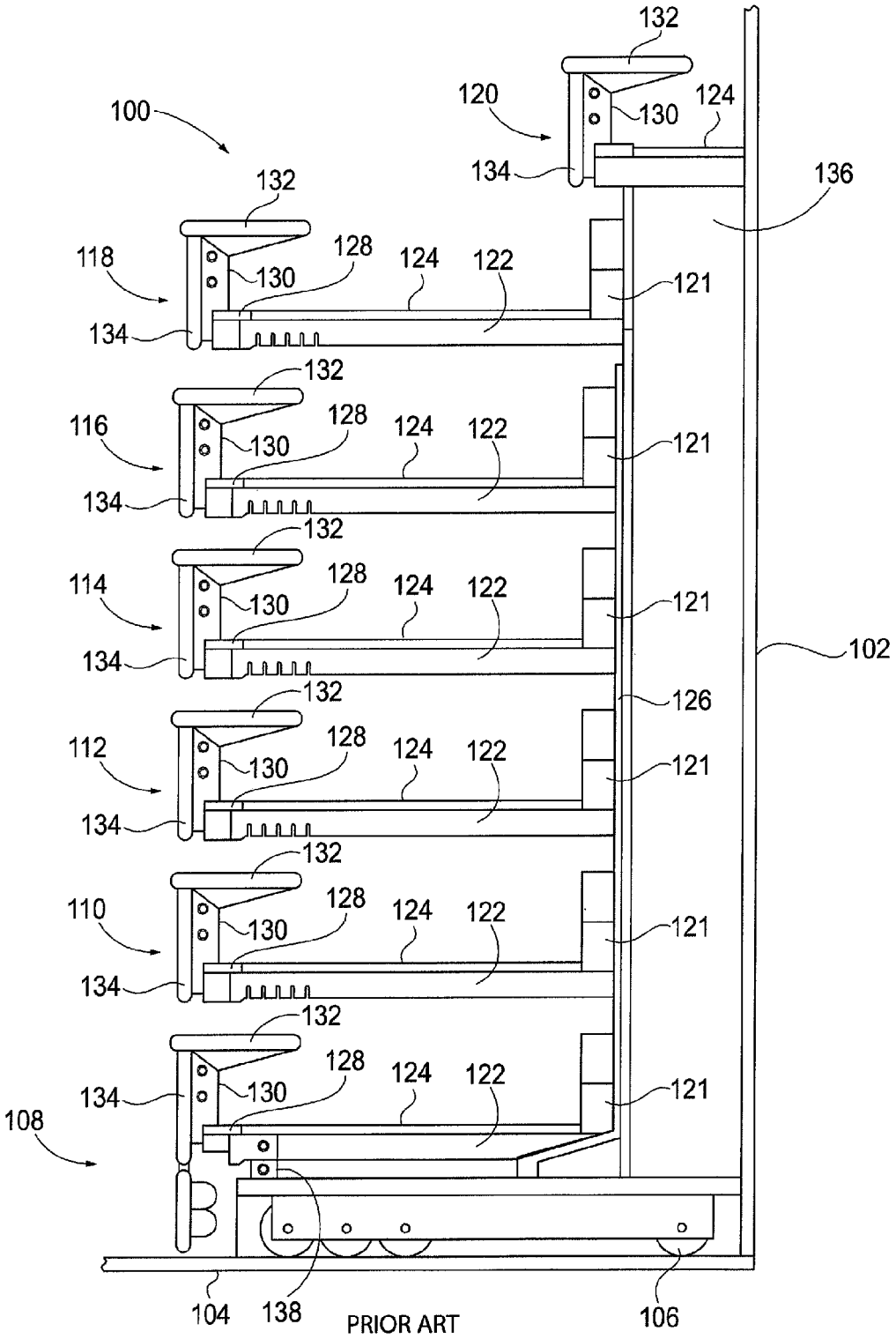
PRIOR ART FIG. 1
FIG. 1 is a side view of a telescoping seating system in accordance with the prior art.

For the purposes of the description hereinafter, the terms "upper," "lower," "right," "left," "vertical," "horizontal," "top," "bottom" and derivatives and equivalents thereof shall relate to the invention as it is oriented in the drawing figures. However, it is to be understood that the invention may assume various alternate variations and step sequences, except where expressly specified to the contrary. It is also to be understood that the specific devices and processes illustrated in the attached drawings, and described in the following specification, are simply exemplary aspects of the invention. Hence, specific dimensions and other physical characteristics related to the aspects disclosed herein are not to be considered as limiting.

Figure 2:
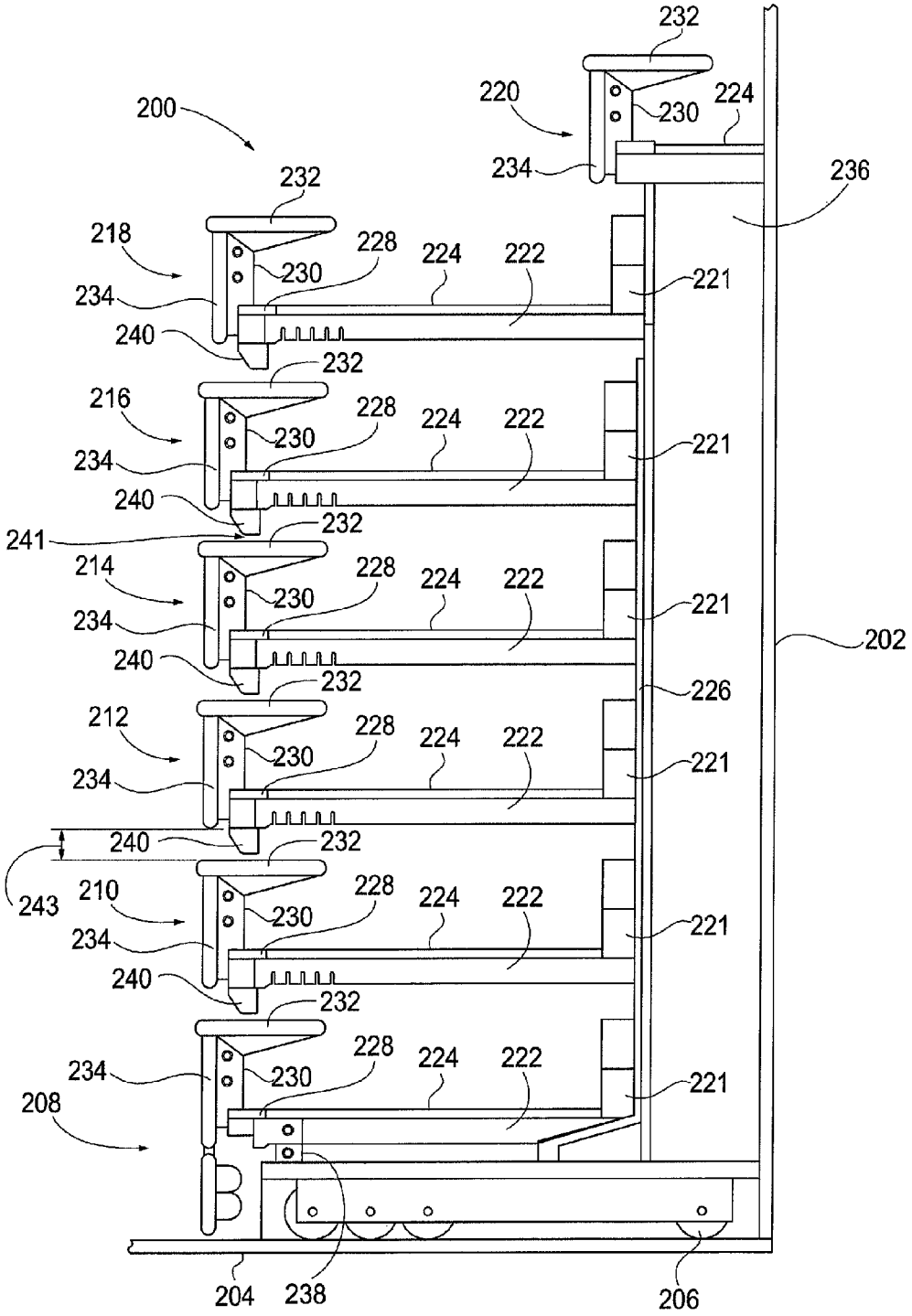
FIG. 2 is a side view of one aspect of a telescoping seating system according to the principles of the present invention.

Referring now to FIG. 2, a telescoping seating system 200 in accordance with an exemplary aspect of the invention is shown. Seating system 200 is shown in a closed position, with a plurality of distinct stacked bleacher levels 208, 210, 212, 214, 216, 218, 220 extending from a wall or other anchor point 202 along a floor 204. In this closed configuration, each bleacher level 208, 210, 212, 214, 216, 218 is retracted such that respective vertical seat portions 234 are substantially flush with the neighboring levels. When bleacher levels 208, 210, 212, 214, 216, 218 are in an open configuration, the levels extend from wall 202 in a step-wise fashion to provide a plurality of accessible seating levels. A wheeled track system 206 enables the plurality of bleacher levels 208, 210, 212, 214, 216 to open in this step-wise fashion along floor 204. As with FIG. 1 discussed above, upper-most bleacher levels 218 and 220 do not extend or retract with the other bleacher levels, as they are fixed to wall 202 and/or a stationary vertical support post 236.

Bleacher levels 208, 210, 212, 214, 216, 218 each have a rear riser beam 221 running the width of at least the seating portion of each bleacher level, two or more perpendicular brace beams 222 extending from rear riser beam 221, a nose beam 228 attached to brace beams 222 and running parallel to riser beams 221, a foot platform 224, a seat bracket 230 attached to nose beam 228, a horizontal seat portion 232 attached to seat bracket 230, and a vertical seat portion 234 attached to seat bracket 230. Foot platform 224 may be formed of any appropriate material, such as wood, metal, etc. Likewise, horizontal seat portion 232 and vertical seat portion 234 may be formed of any appropriate material, such as plastic, wood, metal, etc. For strength purposes, all beams are preferably metallic, but may be made from any material of having suitable load-bearing strength characteristics. While not shown in FIG. 2, each bleacher level 208, 210, 212, 214, 216, 218 also has two or more vertical support posts 226. Riser beams 221 are attached to vertical support posts 226, and when in an open configuration, vertical support posts 226 for each bleacher level 208, 210, 212, 214, 216 also provide vertical support for the bleacher level immediately above.

Telescoping seating system 200 further has one or more vertical support elements 240 attached to the underside of nose beams 228 for at least one bleacher level 210, 212, 214, 216, 218. Vertical support elements 240 fit into an opening or gap 243 created between the horizontal seat portion 232 and the bottom surface of nose beam 228 of adjacent bleacher levels when seating system 200 is in a closed position. Preferably, there is a small gap 241 (e.g., 1/16" or 1/8") between the bottom surface of each vertical support element 240 and the adjacent horizontal seat portion 232 such that vertical support element 240 does not interfere with smooth opening and closing of seating system 200. However, in some aspects, there may be no gap present between the vertical support element 240 and adjacent horizontal seat portions 232, such that the element 240 rests directly on seat portions 232 when in the closed position. As the seating system 200 is opened and closed, it is desirable for the one or more vertical support elements 240 to be sized and positioned so as to minimize substantially direct contact with the adjacent horizontal seat portion 232. In this instance, substantially direct contact is defined as contact that interferes with smooth opening and closing of seating system 200.

The presence of vertical support elements 240 provides vertical support to the front of each bleacher level 210, 212, 214, 216, 218 when the system 200 is in the closed position, whereas without vertical support elements 240, the bleacher levels above lowest bleacher level 208 may sag due to gravity forces and/or individuals climbing or sitting on system 200 when closed. Lowest bleacher level 208 will not require one or more vertical support elements 240, as it is vertically supported via a front vertical support beam 238 connected to wheeled track system 206 extending to floor 204. Likewise, upper-most bleacher level 220 may not require one or more vertical support elements 240 when it does not extend outward from wall 202 in a similar fashion as bleacher levels 210, 212, 214, 216, 218 and obtains front vertical support via vertical support post 236.

Figure 3:
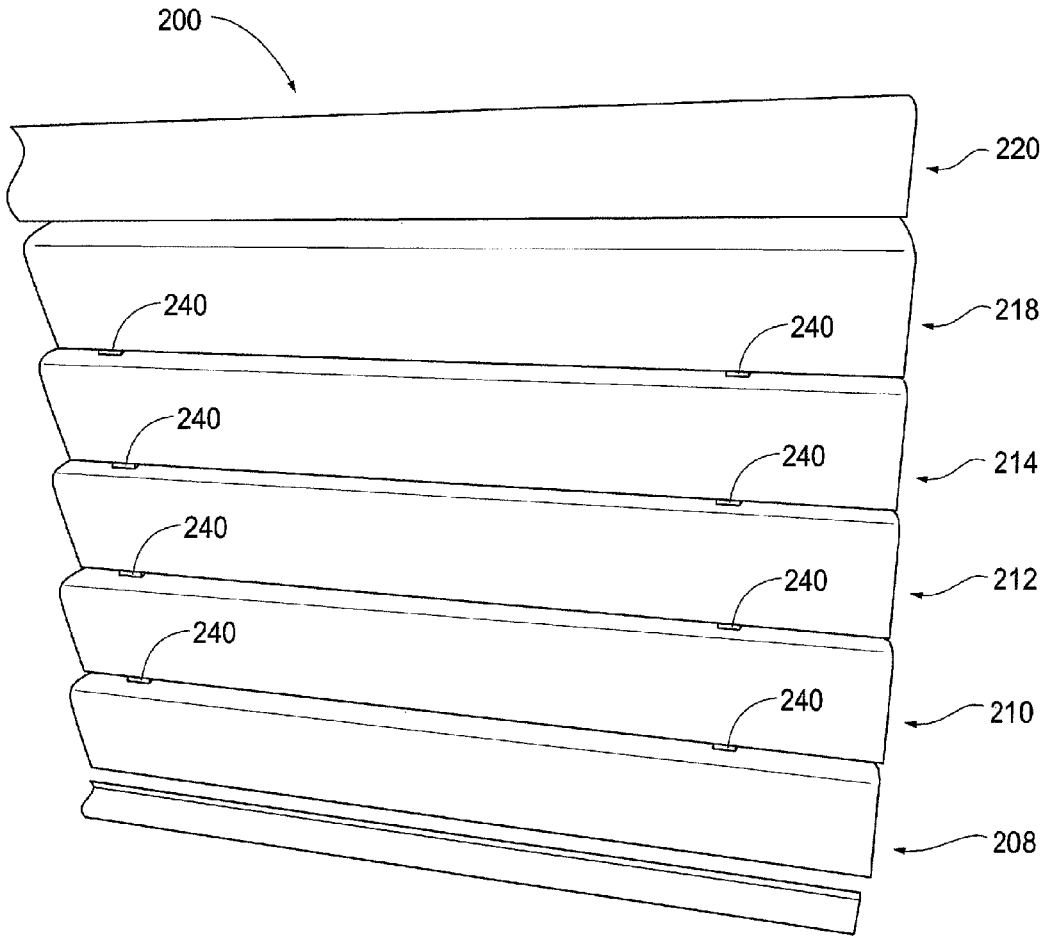
FIG. 3 is a front view of one aspect of a telescoping seating system according to the principles of the present invention.

Vertical support elements 240 provide solid, weight-bearing structural support to otherwise unsupported nose beams 228 of bleacher levels 210, 212, 214, 216, 218. To achieve support for the entirety of each bleacher level 210, 212, 214, 216, 218, a plurality of vertical support elements 240 may be installed at intervals across the face of the bleacher system 200. For example, FIG. 3 shows a front view of a closed seating system 200 having a plurality of vertical support elements 240 affixed to the nose beams at regular intervals across respective bleacher levels 210, 212, 214, 218. The exact spacing between vertical support elements 240 may vary dependent upon field conditions, length of seating span, etc., and is not limited to the number and distance shown in FIG. 3. Additionally, the number and spacing of vertical support elements 240 may vary between different bleacher levels 210, 212, 214, 216, 218.

Figure 4:
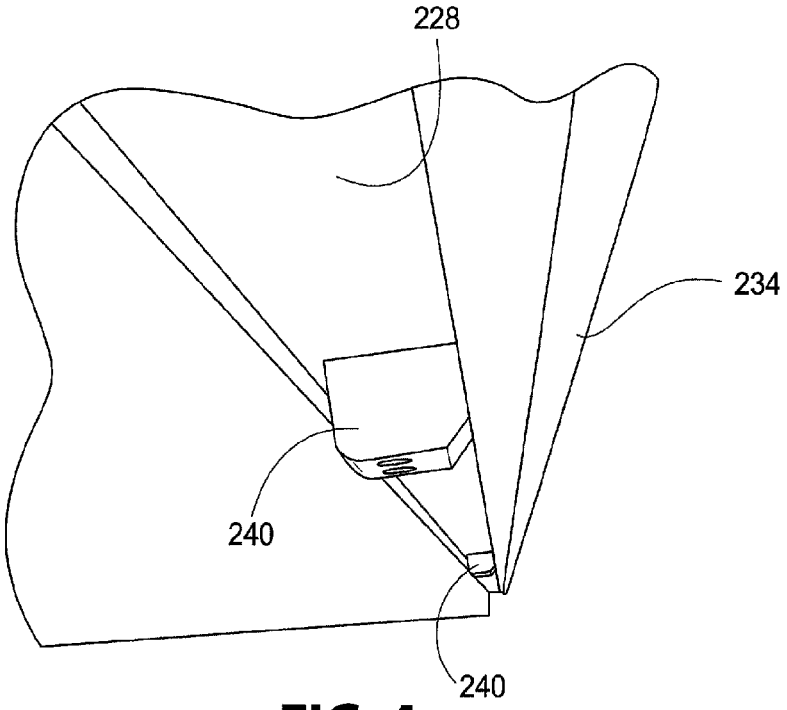
FIG. 4 is an underside perspective view of one aspect of portions of a seating level and vertical support elements according to principles of the present invention.
Figure 5:
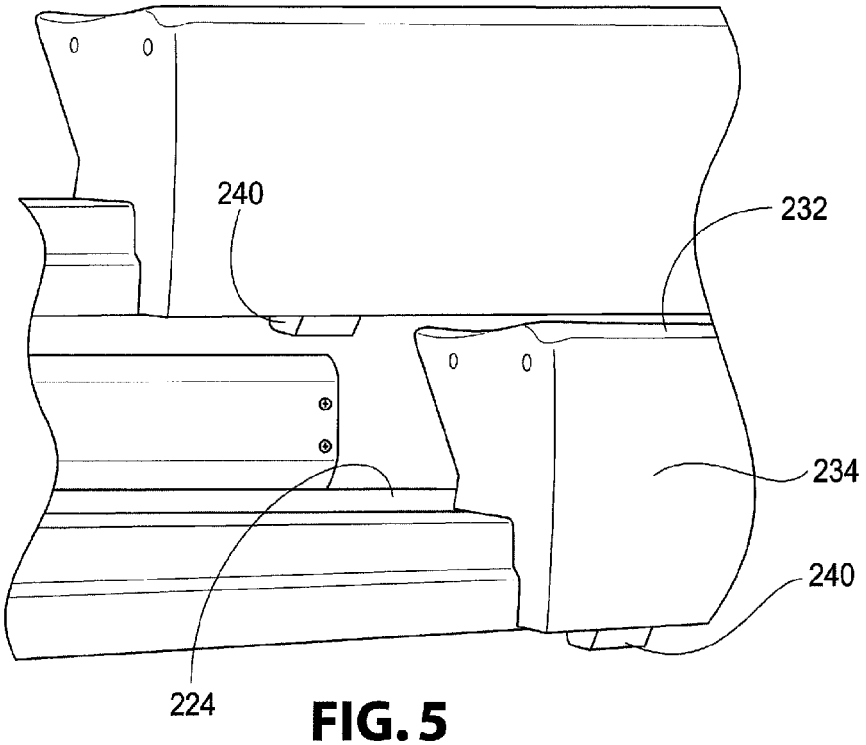
FIG. 5 is a front perspective view of one aspect of a seating level in an open configuration according to principles of the present invention.

Referring to FIG. 4, an exemplary underside view of attached vertical support elements 240 is shown. Again, vertical support elements 240 may be fixedly attached to the underside of each nose beam 228, behind vertical seat portion 234. In this way, vertical support elements 240 do not interfere with or alter the actual seating area in any way, nor do they interfere with movement of individuals to or from the seating areas of each bleacher level. FIG. 5 illustrates this feature, as vertical support elements 240 are visible when the seating system is in an open configuration, but vertical support elements 240 in no way interfere with the seating area or foot platform 224. However, because vertical support elements 240 are visible and mounted on nose beams 228, they are advantageously accessible in the event that there is a need for repair, replacement, or removal of a vertical support element 240, or if it is desired to add additional vertical support elements 240 to a given nose beam 228.

Figure 6:
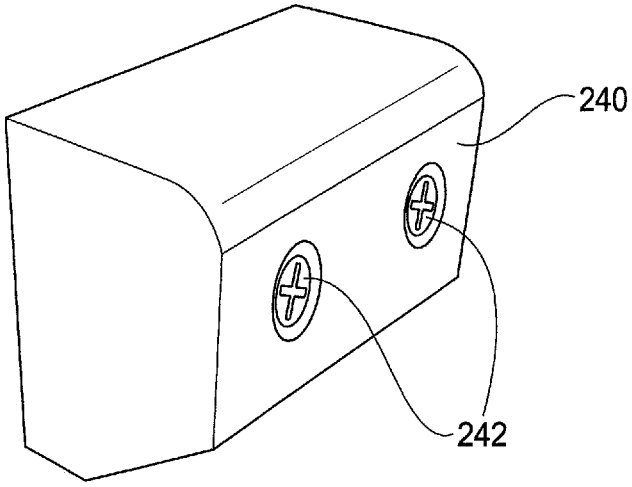
FIG. 6 is a perspective view of one aspect of a vertical support element according to principles of the present invention.
Figure 7:
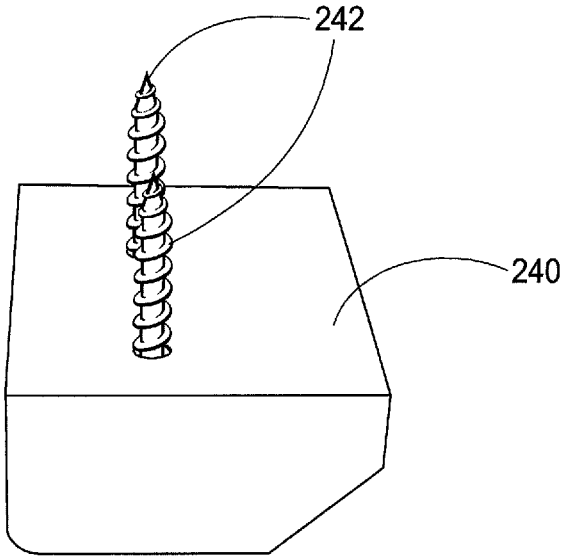
FIG. 7 is a bottom perspective view of one aspect of the vertical support element of FIG. 6.

FIG. 6 and FIG. 7 each show a vertical support element 240 having exemplary attachment hardware 242 located in a hardware opening formed through vertical support element 240. Attachment hardware 242 is shown as two metallic screws in FIG. 6 and FIG. 7, which enables vertical support element 240 to easily be removably attached to a nose beam or other underside structure of a bleacher level. Attachment hardware 242 is preferably vibration-resistant to prevent unintended detachment from the underside structure. While metallic screws are shown as attachment hardware 242 in FIG. 6 and FIG. 7, any suitable hardware or attachment method is within the scope of an exemplary aspect of the invention. For example, bolts and nuts, rivets, or other similar hardware may be used, or a suitable adhesive may instead be used to mount vertical support element 240. In addition, while the examples shown above illustrate attachment of a vertical support element 240 to the underside of the nose beam 228, it is also possible for attachment to be made to a face side of the nose beam 228, or attachment to another underside component of the overall bleacher level. Alternatively, one or more vertical support elements 240 may be formed integrally with a structural component of one or more bleacher levels. For example, one or more vertical support elements 240 may be formed as an integral part of a nose beam if the nose beam is stamped, welded, molded, or otherwise permanently formed.

Figure 8:
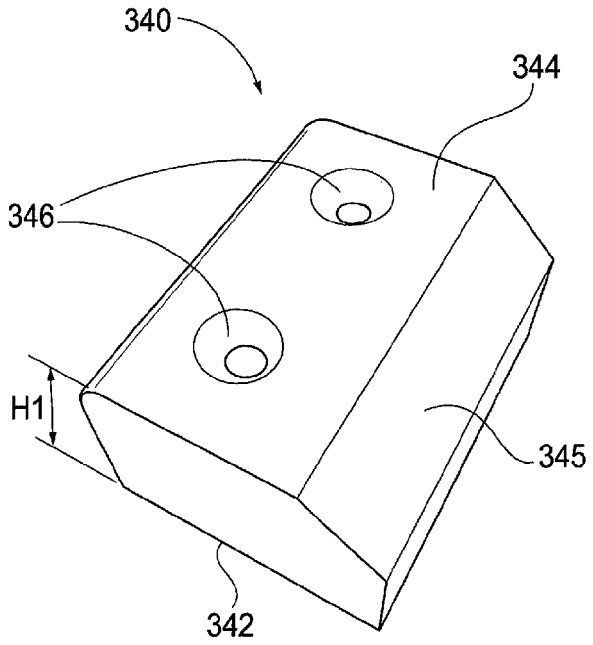
FIG. 8 is a perspective view of one aspect of a vertical support element according to principles of the present invention.

Referring now to FIG. 8, a perspective view of a vertical support element 340 according to an exemplary aspect is shown. Vertical support element 340 is substantially wedge-shaped, having a first side 342 that comprises a substantially flat surface, and a second side 344 having at least once chamfered edge 345 thereon. Two attachment hardware recesses 346 are also shown. However, more or fewer hardware recesses 346 are also possible, and if a non-hardware-based attachment method is to be utilized, hardware recesses 346 may be eliminated. Vertical support element 340 is configured to be mounted to the underside of the nose beam or other bleacher structure, with first side 342 contacting the underside structure and chamfered edge 345 facing outward, away from the wall or other anchor structure. With chamfered edge 345 in this orientation, the vertical support element 340 allows for easier sliding over the rear edge of a seat portion located below vertical support element 340 in the event that any physical contact is made between the vertical support element 340 and the seat portion during opening and closing of the bleacher system. However, as discussed above, it is desirable that vertical support element 340 be sized and spaced such that no contact is made with seat portions during opening and closing operations, with a minimal gap formed between vertical support element 340 and the top of a seat portion when the bleacher system is in the closed position. In the event of vertical loading on the front of the bleacher system when in the closed position, the minimal gap will close, and the plurality of vertical support elements 340 affixed to each unsupported level in the bleacher system will provide vertical support to the front of the bleacher structure all the way to the floor, thereby preventing structural damage to the bleacher system due to unsupported front loading.

Figure 9:
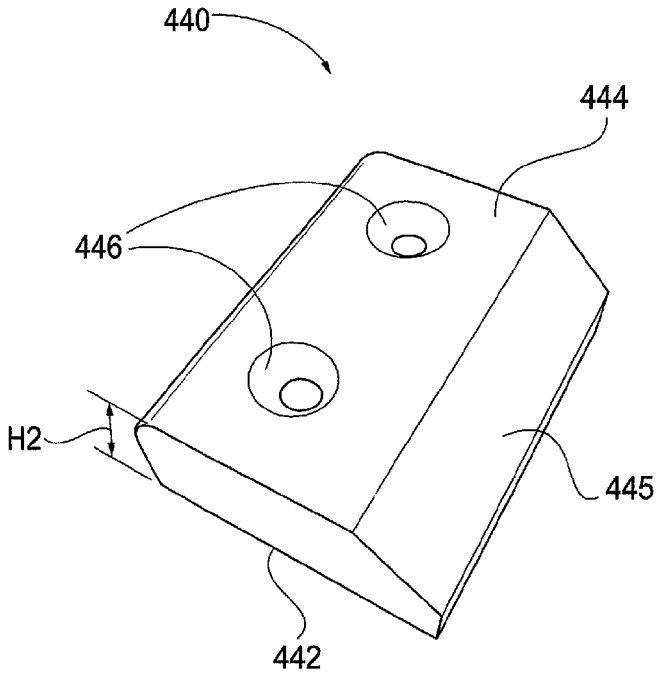
FIG. 9 is a perspective view of another aspect of a vertical support element according to principles of the present invention.

Vertical support element 340 may be made of any suitable weight-bearing material, such as plastic, rubber, metal, etc. In addition, vertical support element 340 may be shaped and sized appropriately to reduce any friction from potential contact with the seat surface below during opening and closing of the bleacher system. Vertical support element 340 in FIG. 8 is shown having a height H1, wherein height H1 may be chosen based on the make and model of the bleacher system, as well as any existing gap spacing between bleacher levels. However, vertical support elements are not limited to a single height H1, and are in fact preferably customized to fit a specific bleacher make and model and/or the spacing limitations of a specific application. For example, FIG. 9 shows a vertical support element 440 having similar overall features to vertical support element 340, such as a first side 442, a second side 444 with at least one chamfered edge 445, and a plurality of hardware recesses 446. However, vertical support element 440 has a much shorter height H2 as compared to the height H1 of vertical support element 340. This enables vertical support element 440 to be used in bleacher systems where the gap between bleacher levels is narrower. This narrower gap may be by the manufacturer's design, or it may be caused by the use conditions of the bleacher system. For example, a bleacher system being retrofit with vertical support elements may have already sustained some structural bending, and thus certain gaps between bleacher levels may be larger or smaller than others. Additionally, uneven floors may also cause varying gap widths between bleacher levels. Accordingly, the ability to utilize customizable vertical support elements having varying heights ensures greater flexibility in providing front vertical support to a wide array of bleacher systems. Without these customizable vertical support elements, the chance of contact between the seat portions and the vertical support elements during opening and closing is increased, which may cause the bleacher system to stall, make noise, and potentially become damaged.

Figure 10:
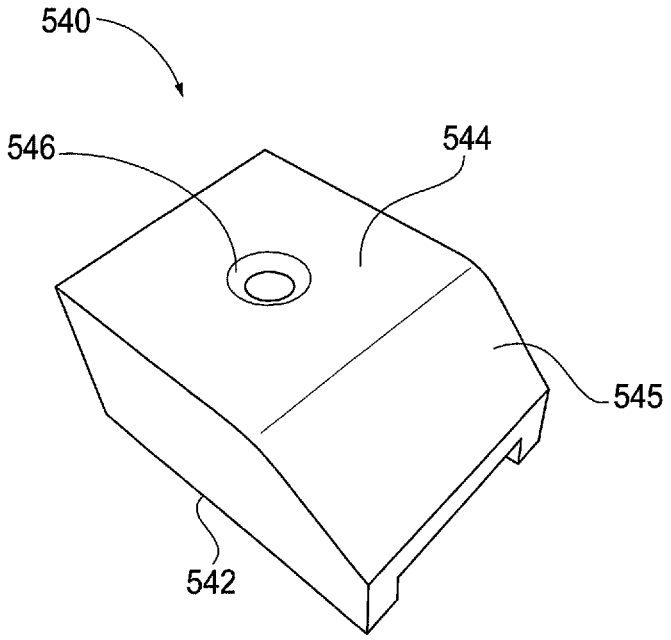
FIG. 10 is a perspective view of yet another aspect of a vertical support element according to principles of the present invention.
Figure 11:
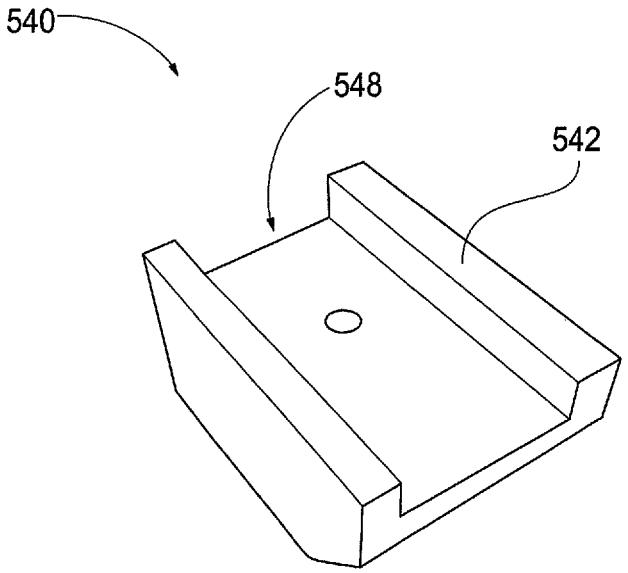
FIG. 11 is a bottom perspective view of the vertical support element of FIG. 10.

Referring now to FIG. 10 and FIG. 11, a vertical support element 540 in accordance with another exemplary aspect is shown. In some instances, the nose beam of the bleacher system does not run parallel to the rear riser and seat portion, but instead runs perpendicular to the rear riser seat portion. Accordingly, vertical support element 540 is modified from those shown above in FIG. 8 and FIG. 9 so as to accommodate attachment to such a perpendicular nose beam. Namely, vertical support element 540 comprises a first side 542 and a second side 544, with second side 544 having a chamfered edge 545. An attachment hardware recess 546 is shown, and again, more or fewer attachment hardware recesses 546 are possible. First side 542 further comprises a channel 548, which is sized to fit the width of a perpendicular nose beam to aid in attachment of vertical support element 540. The height of vertical support element 540 may be customized based on the make/model of bleacher system, and/or based on the current condition of the bleacher system, as discussed above. In operation, vertical support element 540 is spaced between a perpendicular nose beam and a seat portion so as to provide front vertical structural support to a bleacher system in the event or vertical loading on the bleacher system.

The preferred aspects of the invention have been described in detail herein. However, it will be appreciated by those skilled in the art that various modifications and alternatives to the preferred aspects may be made to the invention without departing from the concepts disclosed in the foregoing description. Such modifications are to be considered as included within the following claims unless the claims, by their language, expressly state otherwise. Accordingly, the particular aspects described in detail hereinabove are illustrative only and are not limiting as to the scope of the invention, which is to be given the full breadth of the appended claims and any and all equivalents thereof.

The invention claimed is:

1. A telescoping seating system configurable between open and closed positions, the system comprising:

a plurality of seating levels arranged in a vertically stacked orientation, the plurality of seating levels comprising a bottom seating level adjacent a floor and at least one upper seating level above the bottom seating level, the at least one upper seating level comprising:

a seating portion;

a foot platform;

a support structure for supporting the seating portion and the foot platform, wherein the support structure comprises at least one nose beam configured to support at least the seating portion; and at least one vertical support element provided on a surface of the at least one nose beam, wherein the at least one vertical support element is sized and positioned so as to minimize substantially direct contact with the seating portion of an adjacent seating level during opening and closing of the telescoping seating system, with a minimal gap formed between the vertical support element and a top of the seating portion of an adjacent seating level when the seating system is in the closed position, wherein, in an event of vertical loading on a front of the at least one upper seating level when in the closed position, the minimal gap will close, and the at least one vertical support element will provide vertical support to the front of the at least one upper seating level, thereby preventing structural damage to the seating system due to unsupported front loading, wherein the at least one vertical support element comprises a multi-sided unitary block having at least one chamfered edge, the at least one chamfered edge facing outward from the nose beam, wherein two or more vertical support elements are attached to the at least one nose beam, and wherein each of the two or more vertical support elements is sized differently.

2. The telescoping seating system of claim 1, wherein the multi-sided unitary block is solid.

3. The telescoping seating system of claim 1, wherein the two or more vertical support elements are provided on an underside surface of the at least one nose beam.

4. The telescoping seating system of claim 1, wherein the two or more vertical support elements are provided on a side surface of the at least one nose beam.

5. The telescoping seating system of claim 1, wherein the at least one nose beam is oriented parallel to the seating portion.

6. The telescoping seating system of claim 1, wherein the at least one nose beam is oriented perpendicularly to the seating portion.

7. The telescoping seating system of claim 1, wherein the two or more vertical support elements are attached to the at least one nose beam using hardware.

8. The telescoping seating system of claim 1, wherein the two or more vertical support elements are attached to the at least one nose beam using an adhesive.

9. The telescoping seating system of claim 1, wherein the two or more vertical support elements are integrally formed with the at least one nose beam.

10. The telescoping seating system of claim 1, wherein the two or more vertical support elements are formed of one of plastic, rubber, or metal.

11. The telescoping seating system of claim 1, wherein the chamfered edge of the multi-sided unitary block is angled and sized to enable the unitary block to slide over a rear edge of the seating portion in the event of contact.

12. A telescoping seating system configurable between open and closed positions, the system comprising:

a plurality of seating levels arranged in a vertically stacked orientation, the plurality of seating levels comprising a bottom seating level adjacent a floor and at least one upper seating level above the bottom seating level, the at least one upper seating level comprising:

a seating portion;

a foot platform;

a support structure for supporting the seating portion and the foot platform, wherein the support structure comprises at least one nose beam configured to support at least the seating portion; and at least one vertical support element provided on a surface of the at least one nose beam, wherein the at least one vertical support element is sized and positioned so as to minimize substantially direct contact with the seating portion of an adjacent seating level during opening and closing of the telescoping seating system, with a minimal gap formed between the vertical support element and a top of the seating portion of an adjacent seating level when the seating system is in the closed position, wherein, in an event of vertical loading on a front of the at least one upper seating level when in the closed position, the minimal gap will close, and the at least one vertical support element will provide vertical support to the front of the at least one upper seating level, thereby preventing structural damage to the seating system due to unsupported front loading, wherein the at least one vertical support element comprises a multi-sided unitary block having at least one chamfered edge, the at least one chamfered edge facing outward from the nose beam, and wherein the multi-sided unitary block comprises a channel formed therein to conform to the nose beam to which the solid multi-sided unitary block is attached.

13. A plurality of vertical support elements for use in a telescoping seating system having a plurality of vertically arranged nose beams and seating portions, the plurality of vertical support elements comprising:

a plurality of solid multi-sided unitary blocks configured to be fixedly connected to the nose beams of the telescoping seating system; and a plurality of fasteners configured to fixedly connect the plurality of solid multi-sided unitary blocks to the nose beams, wherein each of the solid multi-sided unitary blocks comprises:

a top side configured to engage a respective one of the nose beams;

a bottom side disposed opposite to the top side, the bottom side having at least one chamfered edge defined therein, the chamfered edge being angled and sized to enable the unitary block to slide over a rear edge of a respective one of the seating portions in an event of contact;

a front side extending between the top side and the at least one chamfered edge of the bottom side;

a rear side extending between the top side and the bottom side, a corner of the unitary block between the rear side and the bottom side being rounded;

a left side extending between the top and bottom sides and the front and rear sides;

a right side extending between the top and bottom sides and the front and rear sides; and at least one hardware recess extending through the unitary block from the bottom side to the top side, the at least one hardware recess being configured to receive one of the plurality of fasteners therein such that the fastener does not extend past the bottom side, wherein each of the plurality of solid multi-sided unitary blocks has a height defined between the top side and the bottom side, the height of each of the plurality of solid multi-sided unitary blocks being determined based on a distance between the respective one of the nose beams and the respective one of the seating portions with a minimal gap formed between the bottom side of the solid multi-sided unitary block and the seating portion, wherein a portion of the plurality of solid multi-sided unitary blocks have a different height than another portion of the plurality of solid multi-sided unitary blocks, and wherein each of the plurality of solid multi-sided unitary blocks is configured to provide vertical support to the respective one of the nose beams in an event of vertical loading on the nose beam to prevent structural damage to the seating system due to unsupported loading.

14. The plurality of vertical support elements for use in a telescoping seating system of claim 13, wherein the solid multi-sided unitary blocks are formed of one of plastic, rubber, or metal.

15. The plurality of vertical support elements for use in a telescoping seating system of claim 13, wherein at least one of the solid multi-sided unitary blocks comprises a channel defined in the top side, the channel being configured to conform to the respective one of the plurality of nose beams.

* * * * *